US006214461B1

(12) United States Patent
Omote et al.

(10) Patent No.: US 6,214,461 B1
(45) Date of Patent: Apr. 10, 2001

(54) MODIFIED HYDROPHOBIC TEXTILE PRODUCT

(75) Inventors: Yuichiro Omote, Osaka; Seiichi Ochi, Otsu; Hisao Nishinaka; Shinichiro Inatomi, both of Osaka; Seiji Ishida, Otsu, all of (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 0 days.

(21) Appl. No.: 09/358,725

(22) Filed: Jul. 22, 1999

(30) Foreign Application Priority Data

| | | |
|---|---|---|
| Jul. 23, 1998 | (JP) | 10-207600 |
| Feb. 1, 1999 | (JP) | 11-023800 |
| Feb. 1, 1999 | (JP) | 11-023801 |
| Feb. 1, 1999 | (JP) | 11-023802 |
| Feb. 1, 1999 | (JP) | 11-023803 |

(51) Int. Cl.[7] ..... D02G 3/00; C08J 3/00

(52) U.S. Cl. ..... 428/364; 528/481; 528/486; 528/488; 528/491; 528/499; 428/365

(58) Field of Search ..... 528/481, 486, 528/488, 491, 499; 428/364, 365

(56) References Cited

U.S. PATENT DOCUMENTS 3,779,881 * 12/1973 Sakurada et al. ..... 204/159.15

FOREIGN PATENT DOCUMENTS 0 811 718 * 12/1997 (EP) .
0 814 191 * 12/1997 (EP) .
55-107514 * 8/1980 (JP) .

* cited by examiner

*Primary Examiner*—Samuel A. Acquah
(74) *Attorney, Agent, or Firm*—Foley & Lardner

(57) ABSTRACT

A hydrophobic textile product of the present invention is obtained through graft polymerization of an ethylenically unsaturated organic acid. The textile product characterized by: a graft polymerization rate of about 8 wt % or more; substantially no agglutination of a byproduct polymer from the graft polymerization process; a hygroscopicity of about 2.5 wt % or more under a 20° C.×65% RH environment; and an ammonia deodorizing property.

19 Claims, 1 Drawing Sheet kfd-537.bmp kfd-537.bmp kfd-542.bmp

MODIFIED HYDROPHOBIC TEXTILE PRODUCT

BACKGROUND OF THE INVENTION

1. Field of the Invention

The present invention relates to a modified hydrophobic textile product. More particularly, the present invention relates to a textile product having desirable properties such as a high hygroscopicity as well as an ammonia deodorizing property, an SR soil resistance, and an antistatic property, which is obtained by graft polymerization of a hydrophobic textile product with a radical polymerizable compound such as an ethylenically unsaturated organic acid, and a method for producing the same.

The term "textile product" as used herein refers to fiber or a product obtained by processing fiber, including staple fiber, cotton, tow, filament, false-twisted yarn, blended yarn, conjugate yarn, spun yarn, woven fabric, knitted fabric, and nonwoven fabric, as well as those using the same including clothing, floor coverings, interior goods, bedding, and the like. The term "cotton" as used herein refers to a physical form of a fiber which has a form similar to a natural cotton ball.

2. Description of the Related Art

Hydrophobic fiber (the term "hydrophobic fiber" is used herein in the singular, although it is intended to include a plurality of fiber materials as defined below) such as a polyester fiber and a polyamide fiber is sued in a wide variety of applications ranging from clothing to industrial materials, for its advantageous physical and chemical properties and low cost. However, due to the inherent characteristics thereof, hydrophobic fiber is relatively poor in water absorbing property and hygroscopicity, and therefore has problems as follows: it is easily electrically charged; oily soil easily attaches to it and difficult to remove therefrom; it is easily resoiled during washing; it has substantially no deodorizing property; etc. These problems are more pronounced especially when it is used in textile applications. For example, due to the substantially no water absorbing property or hygroscopicity, a textile product made of hydrophobic fiber is not comfortable when worn, as the product may get sticky and make the wearer feel hot and sweaty, while it may easily be electrically charged. Moreover, such a textile product is also poor in practical utility, as dust floating in the air easily attaches to it due to the static electricity, and ordinarily oily dirt also easily attaches to the product, such as lipid dirt (including dirt from hands, dirt on the collar, body grease, and the like), edible oil, machine oil, and hair dressing. Such dirt is difficult to remove by washing, and the product is easily resoiled during washing.

Conventionally, various methods have been proposed for overcoming these problems. For example, proposed methods for improving the water absorbing property and hygroscopicity of a polyester fiber include: a method which employs, in the polymerizable step, copolymerizable of various hydrophilic compounds (e.g., an alkylene glycol or polyalkylene glycol-type compound, a polyalkylene glycol denaturated polyester-type compound, or other hygroscopic compounds); a method in which such hydrophilic compounds are mixed in the reeling step; and a method in which such hydrophilic compounds are added with a binder, or the like, in an aftertreatment. In methods in which a hydrophilic compound is incorporated into a polyester fiber in the polymerizable step or in the reeling step, the product will not have a stiff feeling, and a desirable washing resistance is obtained. However, when the amount of the additive is increased in order to provide a sufficient hygroscopicity, the mechanical properties inherent to a polyester fiber are deteriorated, while substantially reducing the reelability. Therefore, these methods have only been used in limited applications where improving only the hygroscopicity is acceptable. On the other hand, in methods in which a hydrophilic compound is added in an aftertreatment, a desirable water absorbing property and hygroscopicity can be provided, but the product will have a stiff feeling and a poor washing resistance.

As a method for improving the washing resistance including the water absorbing property and hygroscopicity after washing, there has been proposed a method in which a synthetic polymer product is graft-polymerized with an ethylenically unsaturated organic acid such as acrylic acid or methacrylic acid, after which the carboxylic acid terminal introduced by the graft polymerization is converted to an alkali metal salt. However, the method of graft-polymerizing a hydrophobic polymer product with such an ethylenically unsaturated organic acid generally results in a low polymerization efficiency, and the graft polymerization is likely to be non-uniform.

Exemplary graft polymerization methods known in the art include: a two bath method in which an aqueous emulsified dispersion comprising a hydrophobic radical initiator, an initiator solvent, a swelling agent for a hydrophobic synthetic polymer, and an emulsifier, is attached to a hydrophobic synthetic polymer, and heated and washed with water so as to introduce a polymerization activity center to the polymer, after which a monomer having a double bond capable of radical polymerization is allowed to act upon the polymer (Japanese Publication for Opposition No. 45-502): and a one bath method in which an aromatic polyester product is processed with an aqueous dispersion which comprises a hydrophobic organic solvent, a hydrophobic radical initiator, a hydrophilic monomer having a double bond capable of radical polymerization, and an emulsifier (Japanese Publication for Opposition No. 48-27743). The two bath method involves complicated steps, and requires a long time. Moreover, it is difficult to perform a stable and uniform graft polymerization because of the fluctuation in the graft rate, and the non-uniformity of the graft polymerization. On the other hand, the one bath method has an advantage of being a single-step method, but results in disadvantages such as a non-uniform graft polymerization and a low graft polymerization efficiency. When the concentration of the hydrophilic monomer is increased while the bath ratio is decreased in this method, the graft efficiency can be significantly improved, but the uniformity of the graft polymerization further decreases, while the ungrafted polymer, which is a byproduct of the graft polymerization, is likely to agglutinate to the polymer product.

Also proposed in the art is a method in which a polyester crimped yarn is wound into a cheese, and a hydrophobic radical initiator, a hydrophobic organic solvent and a hydrophilic monomer are provided to allow graft polymerization (Japanese Laid-Open Publication No. 48-096894). However, the method has problems of noxious vapors and poor work environment due to the use of an organic solvent.

Moreover, it is also conventionally known in the art to use a carrier as a swelling agent for a hydrophobic polymer in the graft polymerization step, in order to improve the graft efficiency. However, the odor of the carrier is very distinctive and strong, which may remain in the final product.

In applications such as clothing, bedding, household commodities, and interior goods, the ammonia odor from sweat and urine is often the problem to be addressed.

In order to provide polyester with an ammonia deodorizing function, there has been proposed a method in which a functional agent having an ammonia deodorizing property is added in an aftertreatment. However, the product produced according to this method has a stiff feeling and a poor washing resistance.

It is thought that the durability of a fiber or a textile product can be improved by graft polymerization of an organic acid monomer. However, the mechanical properties of the fiber are substantially deteriorated by the graft polymerization. When an introduced acidic group is converted to a metal salt in order to improve the hygroscopicity, the ammonia deodorizing function is decreased. Thus, it has not been possible in the art to improve both the ammonia deodorizing property and the hygroscopicity.

SUMMARY OF THE INVENTION

According to one aspect of this invention, there is provided a hydrophobic textile product which is obtained through graft polymerization of an ethylenically unsaturated organic acid. The textile product characterized by: a graft polymerization rate of about 8 wt % or more; substantially no agglutination of a byproduct polymer from the graft polymerization process; a hygroscopicity of about 2.5 wt % or more under a 20° C.×65% RH environment; and an ammonia deodorizing property.

In one embodiment of the invention, the hydrophobic textile product is a polyester-based textile product.

In one embodiment of the invention, about 40% or more of acidic groups introduced by the graft polymerization process is converted to an alkali metal salt.

In one embodiment of the invention, about 40 to about 95% of the acidic group is converted to an alkali metal salt.

In one embodiment of the invention, the hygroscopicity is about 5 wt % or more.

In one embodiment of the invention, the graft polymerization rate is about 10 to about 40 wt %.

In one embodiment of the invention, the textile product is a staple fiber, and a staple fiber-metal static friction coefficient thereof is about 0.17 or less.

In one embodiment of the invention, the textile product has a hygroscopicity of about 4 wt % or more under a 20° C.×65% RH environment after 10 iterations of a washing test as described in JIS-L-0217-103.

In one embodiment of the invention, the textile product has an SR soil resistance and an antistatic property.

In one embodiment of the invention, the polyester-based textile product is a polyethylene terephthalate textile product.

In one embodiment of the invention, the polyester-based textile product has a hollow cross section.

In one embodiment of the invention, the textile product is obtained by a method including the steps of: heating a polyester-based textile product in an aqueous emulsion containing a hydrophobic radical initiator, a phthalimide-type compound and an ethylenically unsaturated organic acid, so as to allow graft polymerization; and processing the graft-polymerized polyester-based textile product with an aqueous solution containing a basic alkali metal compound and a sequestering agent.

According to another aspect of this invention, there is provided a method for producing a textile product as described above. The method includes the step of: heating a hydrophobic textile product in an aqueous emulsion containing a hydrophobic radical initiator, a phthalimide-type compound and an ethylenically unsaturated organic acid, so as to allow graft polymerization. The aqueous emulsion is adjusted by a basic alkali metal compound so that the pH thereof is about 2.5 to about 3.5 at room temperature.

In one embodiment of the invention, the method further includes the step of adding an aqueous solution containing a basic alkali metal compound so as to adjust the pH to be about 8 or more and less than about 11.

In one embodiment of the invention, the method further includes the step of adding an aqueous solution containing a basic alkali metal compound so as to adjust the pH to be about 8 or more and less than about 10.

In one embodiment of the invention, the aqueous emulsion further contains a sequestering agent.

In one embodiment of the invention, an amount of the phthalimide-type compound remaining in the obtained textile product is about 200 ppm or less.

In one embodiment of the invention, the method further includes the step of performing a process using an aqueous solution containing a basic alkali metal compound so as to convert about 40 to about 95% of acidic groups introduced by the graft polymerization process to an alkali metal salt.

In one embodiment of the invention, the ethylenically unsaturated organic acid includes acrylic acid and/or methacrylic acid.

The present invention as described above provides: a safe and efficient graft polymerization process with very little odor from the graft polymerization process, substantially no agglutination of a byproduct, a high graft polymerization rate, a high process uniformity, and a high process reproducibility; and a modified hydrophobic textile product produced by such a process, which has a high washing resistance, a high hygroscopicity, an ammonia deodorizing property, an SR soil resistance, and an antistatic property.

Thus, the invention described herein makes possible the advantages of (1) providing a hydrophobic textile product with a high durability, a high hygroscopicity, an ammonia deodorizing property, an SR soil resistance, an antistatic property, etc., without substantially reducing the fiber strength; (2) providing a method for producing a textile product with such properties and, more particularly, a method of graft polymerization of a radical polymerizable compound such as an ethylenically unsaturated organic acid, in which the order from the graft process is reduced, the graft polymerization is uniform, and the polymerization efficiency is high; and (3) providing a graft polymerization method with substantially no agglutination of graft polymerization byproduct, and no problem of remaining odor.

These and other advantages of the present invention will become apparent to those skilled in the art upon reading and understanding the following detailed description.

DESCRIPTION OF THE PREFERRED EMBODIMENTS

Figure 1:
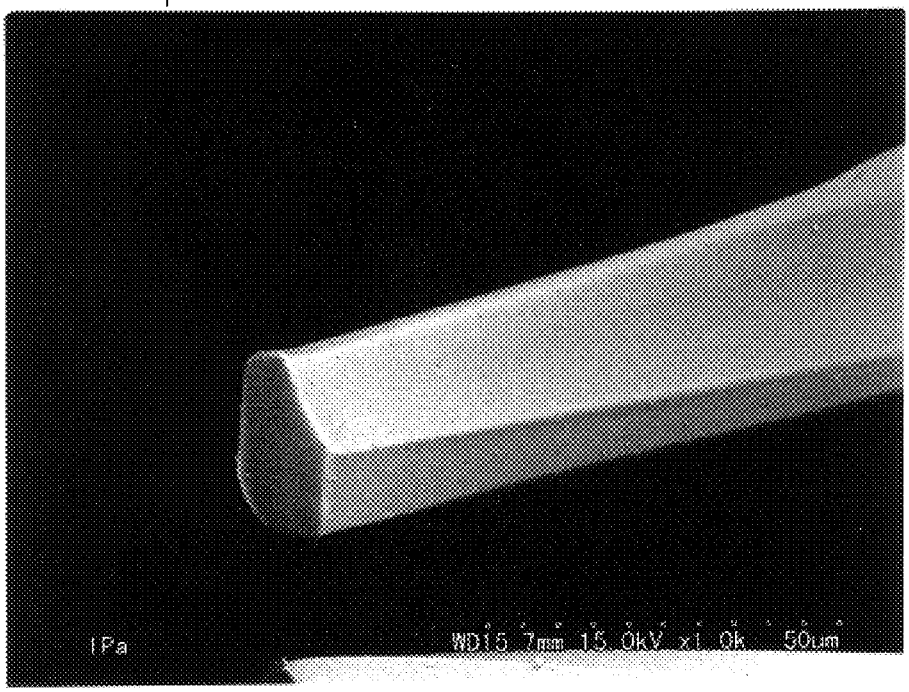
FIG. 1 is an electron micrograph (×1000) showing the surface of an unprocessed polyester staple fiber.
Figure 2:
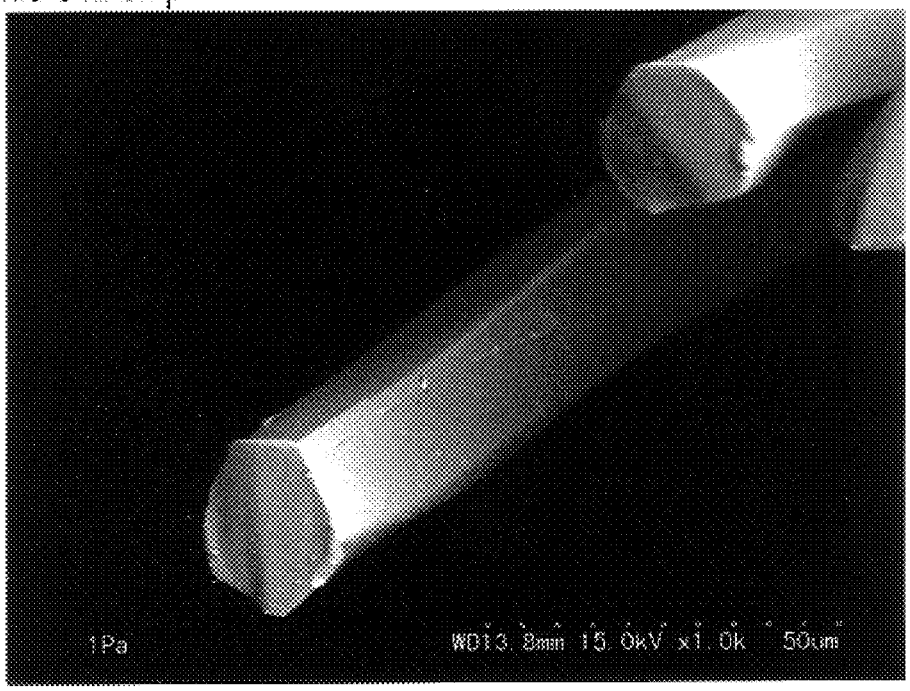
FIG. 2 is an electron micrograph (×1000) showing the surface of a grafted polyester staple fiber according to the present invention.

First, various terms used in this specification will be described.

"Hydrophobic fiber" as used herein refers to a hydrophobic fiber made of a polymer. Preferably, the hydrophobic fiber is an organic polymer fiber such as a polyester, a polyamide, a polyethylene, and a polypropylene. A polyester and a polyamide are more preferred, and a polyester is most preferred. Polyethylene terephthalate is particularly preferred.

"Byproduct polymer" as used herein refers to a byproduct polymer which remains without being graft-polymerized to the textile product after radical polymerization of an ethylenically unsaturated organic acid.

"Agglutination of byproduct polymer" as used herein refers to agglutination between byproduct polymers, or between a byproduct polymer and a hydrophobic fiber.

"Substantially no agglutination of byproduct polymer" as used herein means that there is substantially no agglutination between byproduct polymers or substantially no agglutination between a byproduct polymer and a hydrophobic fiber. "Substantially no agglutination" as used herein means that substantially negligible or no agglutination is observed by an electron microscope at a magnification of about 1000. In various examples of the invention which are provided later in this specification, substantially no agglutination was observed in samples which are evaluated to have "no" agglutination, while those samples which are evaluated to have "slight" agglutination had slight agglutination which was substantially negligible.

"Ammonia deodorizing property" as used herein refers to a function of deodorizing ammonia odor from sweat, urine, etc. In particular, the ammonia deodorizing property as used herein is measured, for example, as follows. Ammonia water is dripped into a 3-liter plastic container so that the ammonia concentration in the container atmosphere is about 100 ppm. Then, about 3 g of a sample is placed in the plastic container, and the container is sealed. After leaving the container standing for about 20 minutes, the ammonia concentration in the plastic container is measured to determine the ammonia deodorizing property. In this test, if the ammonia concentration after standing for about 20 minutes is less than about 100 ppm, it is considered that ammonia has been absorbed. When the ammonia concentration is reduced to be less than about 70 ppm, it is considered that the sample has an ammonia deodorizing property. It is preferred that the ammonia deodorizing property after standing for about 20 minutes is about 50 ppm or less, more preferably, about 30 ppm or less and, most preferably, about 10 ppm or less. An ammonia deodorizing property such that the ammonia deodorizing property after standing for about 20 minutes is about 10 ppm or less will exhibit an excellent ammonia deodorizing property in a practically-used textile product.

"Polyester-based fiber" as used herein refers to a fiber whose main component is polyester. In particular, the polyester-based fiber as used herein includes an ordinary polyester fiber, and a fiber comprising polyester and a small amount of another resin such that the essential function of polyester is not lost. The polyester-based fiber as used herein also includes a fiber comprising any additive known in the art.

In a preferred embodiment, a polyester-based fiber has a hollow cross section. Such a polyester-based fiber having a hollow cross section can be produced by any conventional method known in the art.

"Acidic group introduced by graft polymerization" as used herein refers to an acidic group which is introduced to a hydrophobic polymer by graft polymerization and, more particularly, to a carboxyl group and an acid anhydrous group.

"Stable fiber" as used herein refers to a short fiber cut out from a spun filament.

"Staple fiber-metal static friction coefficient" as used herein refers to a static friction coefficient of a staple fiber against a metal. For example, this can be measured by using the friction coefficient measurement method as described in JIS L-1015, 7.13, but instead of using a cylindrical silver, directly winding the measured sample around a cylinder. For example, a cylinder for use in this measurement may be obtained by hard chrome plating on a stainless steel, such that the maximum height ($R_{max}$) as measured by a surface roughness measurement machine is about 7.0 $\mu$m, and the center line average roughness (Ra) is about 1.0 $\mu$m. The surface roughness may be measured by using, for example, SURFTEST SV402 available from Mitsutoyo. In one embodiment of the present invention, the staple fiber-metal static friction coefficient is preferably about 0.17 or less. In a more preferred embodiment, the coefficient is about 0.16 or less.

"SR soil resistance" as used herein refers to a property by which an oily soil such as dirt from hands, dirt on the collar, body grease, edible oil, or machine oil, is removed from the fiber when washed. "To have an SR soil resistance" as used herein means that such an oily soil is substantially removed from the fiber when washed. In particular, the SR soil resistance can be determined, for example, as follows. After fuel oil B is dripped onto a textile product, the textile product is washed once according to the process as described in JIS-L-0217-103. Then, the remaining soil can be visually determined to be one of Grade 1 to Grade 5 using the gray scale for assessing staining as described in JIS-L-0805. While Grade 2 or higher means a sufficient SR soil resistance, Grade 3 or higher is preferred, and Grade 4 or higher is more preferred, and Grade 5 is most preferred in the present invention.

"Antistatic property" as used herein refers to a property of preventing a textile product from becoming electrically charged. In particular, the antistatic property can be measured under a 20° C.×40% RH environment as described in JIS-L-1094, 5.2. For example, when a textile product is measured to have a frictionally-charged voltage of about 1000 V or less, the textile product can be considered to have an antistatic property. The frictionally-charged voltage is preferably about 900 V or less and, more preferably, about 800 V or less.

"Aqueous liquid" as used herein refers to a water-based liquid such as a solution, a suspension, and an emulsion.

In the present invention, "a textile product" refers to a staple fiber, cotton, tow, spun yarn, filament, blended yarn, twisted yarn, false-twisted yarn, woven fabric, knitted fabric, and nonwoven fabric, as well as clothing, bedding, interior goods, household commodities, and the like, using the same.

In the present invention, a hydrophobic polymer refers to a fiber-forming polymer such as a polyester, a polyamide, and a polyolefin. A polyester is preferred because it best expresses the effect of the graft polymerization process of the present invention.

In the present invention, a polyester as a preferred material for a textile product comprises: a carboxylic acid component selected from terephthalic acid, isophthalic acid, and 2,6-naphthalenedicarboxylic acid; and a glycol component selected from ethylene glycol, propylene glycol, and tetramethylene glycol. For example, a linear polyester, such as polyethylene terephthalate, polytrimethylene terephthalate, polyethylene isophthalate, polybutylene terephthalate, or polyethylene 2,6-naphthalene, is preferred. Polyethylene terephthalate is particularly preferred.

As necessary, a compound or an inorganic particle which provide desirable properties, such as flame proofing, dyeability, antibacterial property, electrical conductivity, heat resistance or light resistance, may be copolymerized with or mixed into a polymer used in the textile product of the present invention. Such a polymer may be used in the form of a filament or a staple fiber with a desired cross-sectional shape and a desired denier.

A filament textured yarn, among various textile products, may be obtained by processing an ordinary melt-spun filament through a process such as a false twisting process, an air jet intermingling process (a Taslan process), or a packed crimping process. Alternatively, a filament textured yarn may be used as a conjugate yarn with another material.

A filament textured yarn is first wound into a cheese or a muff, and then subjected to a graft polymerization process in a package dyeing machine such as an overmayer type machine. In order to obtain a uniform graft polymerization, it is important to appropriately control the winding density of the cheese or muff. Although the appropriate winding density slightly varies depending upon the amount of crimping of the textured yarn, the filament textured yarn is first softly wound normally at about 0.15 to about 0.45 g/cc, and preferably, at about 0.25 to about 0.4 g/cc, and then the wound yarn is set in a kier at about 60° C. to about 100° C. so as to stabilize the shape of the cheese or muff. Then, after a hot water washing or scouring process by an ordinary method, a graft polymerization process is performed. When the winding density is too low (e.g., about 0.15 g/cc or less), unevenness of texture is likely to occur due to possible change in the shape of the cheese or muff in a stream of process liquid. On the other hand, when the winding density is too high (e.g., about 0.45 g/cc or more), unevenness of texture is likely to occur between an inner layer and an outer layer.

The graft polymerization process employed in the production method of the present invention will be described below. First, the ethylenically unsaturated organic acid used in the present invention includes acrylic acid, methacrylic acid, maleic acid, itaconic acid, styrenesulfonic acid, crotonic acid, butentricarboxylic acid, and the like. These ethylenically unsaturated organic acids may be used individually or as a mixture of two or more for graft polymerization. Particularly, acrylic acid and/or methacrylic acid are preferred in terms of the graft polymerization efficiency and cost. An ethylenically unsaturated monomer other than an unsaturated organic acid may additionally be used.

Such an ethylenically unsaturated monomer may be an ethylenically unsaturated organic acid ester, a compound of such an ester into which fluorine or bromine is introduced, or a compound of such an ester into which phosphorus or sulfur is introduced. By additionally using such an ethylenically unsaturated monomer, it is possible to provide further functions such as a water/oil repellent property, or a flame proof.

The graft polymerization rate (GT %) (i.e., the rate of increase in weight, due to graft polymerization, of the ethylenically unsaturated organic acid and other ethylenically unsaturated monomers with respect to a polyester-based textile product) is about 8% or more, preferably, about 10% or more and, more preferably, about 15% or more. When the graft polymerization rate is excessively low, it is not possible to sufficiently express a desired hygroscopicity, ammonia deodorizing property, SR soil resistance, and anti-static property. When the graft polymerization rate is excessively high, it is possible to provide a high level of hygroscopicity or ammonia deodorizing property. However, a byproduct ungrafted polymer is likely to agglutinate to the fiber, and the fiber properties deteriorate substantially. The graft polymerization rate (GT %) can be calculated from the increase from the absolute dry weight of the unreacted fiber (W0) to the absolute dry weight of the fiber after graft polymerization and washing (W1), according to the expression shown below.

$$\text{Graft polymerization rate (GT \%)} = (W1 - W0) \times 100 / W0$$

The graft polymerization process employed in the production method of the present invention may be any appropriate method known in the art, including a radiation irradiation method, an electron beam irradiation method, an ion discharge method, a thermal oxidation method, an ozone oxidation method, a catalyst method, and the like. Particularly, the catalyst method may be used in a wide variety of applications. Moreover, another desired method is to immerse and heat a polyester-based textile product in an aqueous emulsion comprising a hydrophobic radical initiator, a phthalimide-type compound, alkylene glycol, and an ethylenically unsaturated organic acid. Using these methods, it is possible to perform a uniform graft polymerization process with reduced deterioration of the fiber properties and in an efficient manner.

The concentration of the ethylenically unsaturated organic acid in a graft polymerization process liquid is preferably about 1 wt % to about 10 wt % and, more preferably, about 3 wt % to about 4 wt %. When the monomer concentration is excessively high, there will be a large amount of ungrafted byproduct polymer, whereby the agglutination of the byproduct polymer is more likely to occur. Normally, the graft polymerization rate can be adjusted in the range of about 2% to about 100% by performing a graft polymerization process while appropriately selecting the monomer concentration. In the present invention, a graft polymerization rate of about 8% or more is employed.

As the graft polymerization rate increases, the properties such as the hygroscopicity and the SR soil resistance also increase, but then the fiber strength or the feeling tend to deteriorate. Therefore, a graft polymerization rate of about 35% is preferred in a practical use. The graft-polymerized fiber has a hygroscopicity of about 2.5 wt % or more and, more preferably, about 3.0 wt % or more.

The hydrophobic radical initiator may be benzoyl peroxide, toluylperoxide, aromatic alkylperoxide, dichlorobenzoyl peroxide, dicumylperoxide, azobisbutyronitrile, cumene hydroperoxide, perbenzoic acid ester, or the like. They may be used individually or as a mixture of two or more. The amount of such a hydrophobic radical initiator used is preferably in the range of about 0.01 wt % to about 5 wt % with respect to the graft polymerization bath.

A phthalimide-type compound refers to a compound having a phthalimide group. An N-substituted phthalimide compound is preferred, which has an aliphatic or aromatic alkyl group, or the like, at the N group of phthalimide. An N-alkyl phthalimide-type compound having a low molecular weight aliphatic alkyl group such as methyl, ethyl, propyl, isopropyl, butyl, or isobutyl is more preferred in terms of the amount of phthalimide-type compound remaining after the process, the odor, the safety, the handling property. These compounds may be used individually or as a mixture of two or more.

The amount of phthalimide-type compound used in the method of the present invention is preferably about 0.1 wt % to about 2.0 wt % and, more preferably, about 0.1 wt % to about 1.0 wt % with respect to the graft polymerization bath. As compared to a conventional swelling agent (carrier), a phthalimide-type compound has less odor and provides better work environment. When the amount of the compound used is excessively small, the graft polymerization may not be uniform and the polymerization rate may not be improved. On the other hand, when the amount of the compound used is increased over the above-described range, the polymerization rate will not be further improved, while increasing the amount of the phthalimide compound remaining in the final product. Consequently, odor is likely to remain, and there will also be other problems in terms of the safety, the cost for the processing liquid, and the reactivity.

A surfactant used in the present invention for stabilizing the polymerization bath may be any of a non-ion type, an anion type, a cation type, and an amphoteric type. In view of the stability of the emulsifying system and the graft efficiency, the non-ion type, the anion type, or the combination of the non-ion type and the anion type, is preferred.

Other than the commonly-employed surfactants, alkylene glycol may preferably be used. This serves as an aqueous emulsion auxiliary for the phthalimide-type compound and the hydrophobic radical initiator. Those which are preferably used include water-soluble alkylene glycol or polyalkylene glycol having a carbon number of about 2 to about 10, such as ethylene glycol, propylene glycol, butylene glycol, or diethylene glycol. The alkylene glycol may be added at a concentration of about 10 wt % to about 30 wt % with respect to the phthalimide-type compound. When the amount of glycol added is excessively small, the aqueous emulsion of the phthalimide-type compound and the hydrophobic radical initiator is insufficient, whereby a uniform and efficient graft polymerization process cannot be obtained. Moreover, even when the amount of glycol added is increased over the above-described range, the polymerization rate will not be further improved, while increasing the waste liquid load in the process bath. Thus, there will be problems in terms of the safety, the cost for the processing liquid, and the reactivity.

According to the present invention, it is possible to effect the aqueous emulsifying or dispersing of the phthalimide-type compound and the hydrophobic radical initiator without using a commonly-employed surfactant. Therefore, a uniform and efficient graft polymerization process can be performed. In order to remove the phthalimide-type compound and the alkylene glycol component which are adsorbed to the surface or the inside of the processed fiber, it is preferred to perform a dry heat or high temperature steaming process at about 140° C. or more, after performing the post graft polymerization processes including a neutralization process by adding an alkali metal salt or a washing process with hot water. According to this method, the amount of the phthalimide-type compound can be reduced to a level practically free of the odor problem, i.e., about 2000 ppm or less and, more preferably, about 1000 ppm or less.

In order to increase the graft efficiency with the method of the present invention, it may be necessary to use an alkali metal compound to adjust pH of the graft polymerization bath having the above-described composition at room temperature to be about 2.5 to about 3.5 and, more preferably, about 2.7 to about 3.4. When the pH is excessively low, the graft rate is reduced, whereby the byproduct of ungrafted polymer increases and agglutinates to the fiber surface, while the fiber properties easily deteriorate. When the pH is excessively high, the graft rate is reduced.

The pH adjuster may be a water soluble alkaline compound such as sodium hydroxide, potassium hydroxide, lithium hydroxide, an alkali metal carbonate (e.g., potassium carbonate), an alkali metal salt of an inorganic weak acid (e.g., disodium phosphate, trisodium phosphate, sodium pyrophosphate, sodium tripolyphosphate, and tripotassium phosphate), an alkali metal salt of an organic acid (e.g., sodium acetate, sodium propionate, sodium acrylate, and sodium methacrylate). Particularly, an alkali metal salt of an inorganic weak acid is suitable for it is easy to handle.

For example, were a polyester-based filament textured yarn is used, a polyester-based filament textured yarn, which has been softly wound by an ordinary method into a cheese or a muff and scoured, is immersed and heated into the adjusted graft polymerization bath under a nitrogen gas atmosphere. The heat treatment is performed normally at about 50° C. to about 150° C. for about 5 minutes to about 3 hours and, preferably, at about 70° C. to about 130° C. for about 15 minutes to about 2 hours. A commonly-employed overmayer type dying machine may be used for this treatment. For uniformity of the graft process between an inner layer and an outer layer, the graft polymerization process is performed while appropriately optimizing the stream circulation direction, the flow rate, and the heating time. The obtained graft polymerization product exhibits a high graft rate of about 8% or more, substantially no agglutination, and an ammonia deodorizing property.

The graft polymerization product may be further processed with an aqueous solution comprising a basic alkali metal compound and a sequestering agent so that an about 40% to about 95% equivalent amount of the total carboxylic acid groups introduced by the graft polymerization is converted to an alkali metal salt, thereby obtaining a textile product which has a desirable washing resistance, a high hygroscopicity, ammonia deodorizing property, SR soil resistance, and antistatic property.

Thus, the graft-polymerized textile product of a preferred embodiment for the present invention is obtained by converting about 40% to about 95% and, preferably, about 50% to about 90%, of the (carboxylic) acid groups of the ethylenically unsaturated organic acid which has been graft-polymerized to an alkali metal salt, thereby providing a high hygroscopicity, SR soil resistance, and antistatic property. Moreover, due to the effect of the about 5% to about 60% equivalent amount of the remaining (carboxylic) acid group, an ammonia deodorizing property is expressed. Furthermore, due to an additional effect provided by Ca ions and Mg ions adsorbed through repeated washing, it is possible to provide an excellent washing resistance to a textile product whose hygroscopicity, SR soil resistance and antistatic property are otherwise easily deteriorated through repeated washing. In addition to this feature, the final product may also have a pH buffering effect against acid rain and alkaline sweat. In order for these features to be expressed in a well balanced manner, it is preferred to perform a neutralization process, in the process with an aqueous solution comprising a basic alkali metal compound and a sequestering agent, by adding increasing amounts of alkali or by adding a low concentration alkali for a number of times, so that the final pH of the process liquid is about 7 or more and less than about 11, preferably, about 7 or more and less than about 10 and, more preferably, about 7.5 or more and less than about 9.5. When the pH of the aqueous solution is less than about 7, it is difficult to obtain a sufficient hygroscopicity. When the pH of the aqueous solution is about 11 or more, the ammonia deodorizing property tends to decrease, whereby the fiber properties easily deteriorate.

Metals which may be used in the alkali metal salt conversion process include sodium, lithium, potassium, and the like. Specific examples of the basic alkali metal compounds include an alkaline metal hydroxide (e.g., sodium hydroxide, lithium hydroxide, and potassium hydroxide), an alkali metal salt of an inorganic weak acid (e.g., sodium carbonate, potassium carbonate, disodium phosphate, trisodium phosphate), an alkali metal salt of an organic weak acid (e.g., sodium acetate, and sodium propionate), and a water-soluble alkaline compound (e.g., sodium sulfate, and sodium silicate). These compounds may be used individually or as a mixture of two or more. The concentration of the alkali metal compound used is normally about 1 g/L to about 10 g/L though it depends on the concentration of the ethylenically unsaturated organic acid added, the temperature of the metal salt conversion process, and the number of iterations of the process.

The sequestering agent used with the above-described alkali metal compound in the present invention may be any appropriate compound known in the art. Typically, the sequestering agent is a condensed phosphate (e.g., sodium pyrophosphate, sodium triphosphate, sodium trimethaphosphate, sodium tetramethaphosphate, or sodium polyphosphate), an ethylenediamine tetraacetate (e.g., ethylenediamine tetraacetic acid diammonium salt, ethylenediamine tetraacetic acid tetrammoniun salt, ethylenediamine tetraacetic acid disodium salt, or ethylenediamine tetraacetic acid tetrasodium salt), an N-hydroxyethyl ethylenediamine-N,N'N'-triacetate, diethylene triaminepentaacetate, glycolether diaminetetraacetate, cyclohexanetetraacetate, or a nitrilotriacetate. The concentration of such a sequestering agent used is typically about 0.01 g/L to about 5 g/L through it depends on the amount of multivalent metal ion being dissolved in water. The above-described alkali metal salt conversion process is typically performed at a temperature ranging from room temperature to about 100° C.

According to one embodiment of the present invention, a hydrophobic textile product whose graft polymerization rate with an ethylenically unsaturated organic acid is about 8% or more is further processed so that an about 40% or more and, preferably, about 40% to about 95% equivalent amount of the total carboxylic acid groups introduced by the graft polymerization is converted to an alkali metal salt, thereby obtaining a textile product which has a hygroscopicity of about 5% or more under a 20° C.×60% RH environment, a desirable ammonia deodorizing property, SR soil resistance, antistatic property, and washing resistance including hygroscopicity, ammonia deodorizing property, SR soil resistance, and antistatic property. The ammonia deodorizing property can be quantified as follows. After about 3 g of a sample to be measured in placed in a 3-liter plastic container, an amount 100 ppm equivalent amount of ammonia water is dripped into the container. Then, after leaving the container sealed at room temperature for about 20 minutes, the ammonia concentration in the container is measured with a gas detecting tube. The level of deodorizing property is evaluated by determining whether the ammonia concentration is about 70 ppm or less after leaving the container standing for about 20 minutes. The SR soil resistance is a measure of the soil release property of a product when washed with respect to oily soil such as dirt from hands, dirt on the collar, body grease, edible oil, or machine oil. After fuel oil B is dripped onto a textile product, the textile product is washed once according to the process as described in JIS-L-0217-103. Then, the remaining soil attached to the textile product is determined to be one of Grade 1 to Grade 5 using the gray scale for assessing staining as described in JIS-L-0805. A common hydrophobic polyester-based fiber is normally of Grade 1, indicating a very poor SR soil resistance. In contrast, the graft-polymerized polyester-based fiber of one embodiment of the present invention has an improved SR soil resistance of Grade 3. The antistatic property was evaluated by measuring (under a 20 C.×65% RH environment) the frictionally-charged voltage of the textile product by the method as described in JIS-L-1094, 5.2. This embodiment is characterized in that the textile product has the various features of the present invention. Particularly, the hygroscopicity is not substantially deteriorated by washing.

A filament or a staple fiber of the textile product of the present invention retains the above-described desirable features and a desirable washing resistance, thus substantially improving the water absorbing property, the hygroscopicity, the SR soil resistance and the antistatic property as well as the ammonia deodorizing property which were all difficult to improve in the prior art. Thus, the filament or the staple fiber of the present invention can be used in various functional material applications where improved comfort/convenience is desired, such as clothing, bedding, interior goods, vehicle interior goods, household commodities, or industrial materials.

A polyester textile product with a high hygroscopicity and ammonia deodorizing property according to a preferred embodiment of the present invention has properties which are not substantially deteriorated by washing. After 10 iterations of the washing test as described in JIS-L-0217-103, the polyester textile product has a hygroscopicity of about 4% or more under a 20 C.×65% RH environment with substantially no deterioration in the ammonia deodorizing property. Thus, such a polyester textile product is very useful in practical applications.

When an oil agent is further added to a staple fiber produced according to the present invention so that the staple fiber-metal static friction coefficient thereof is about 0.17 or less, the staple fiber has a good carding machine passing property, and is useful in various applications such as nonwoven fabric, wadding for bedding, and spinning.

The oil agent may be a polyester-based oil agent, or a silicon-based oil agent. An additional functional agent such as an antibacterial agent, or an anti-mite agent, may be added along with the oil agent.

When a hollow fiber having a hollow cross section and three-dimensional crimping is used as a staple fiber, it is possible to provide light-weight, bulky, and comfortable wadding. A hollow fiber having a cross section such that the modified cross-section coefficient R (sum of the lengths of the inner and outer peripheries of the fiber cross section/(cross-sectional area of the fiber)$^{1/2}$)≧about 4.5 may be optimally used in wadding with high comfort, a light weight, a high hygroscopicity and an ammonia deodorizing property.

The present invention will now be described by way of illustrative examples. Throughout the following examples, various properties are evaluated as follows.

(1) Washing resistance: the washing test as described in JIS-L-0217-103 was repeated for 10 times.

(2) Graft polymerization rate (GT %): Calculated from the increases from the absolute dry weight of the unreacted fiber (W0) to the absolute dry weight of the fiber after graft polymerization and washing (W1) as follows.

$$\text{Graft rate (GT \%)}=(\mathbf{W1}-\mathbf{W0})\times 100/\mathbf{W0}$$

(3) Alkali metal salt conversion rate with respect to the total amount of carboxylic acid terminal group (NA %): Calculated from the decrease from the total amount of carboxylic acid terminal group before the alkali metal salt conversion (A0) to the amount of carboxylic acid terminal group remaining after the alkali metal salt conversion (A1) as follows.

$$\text{Alkali metal salt conversion rate (NA \%)}=(\mathbf{A0}-\mathbf{A1})\times 100/\mathbf{A0})$$

Herein, the total amount of carboxylic acid terminal groups was quantified as follows. Three samples, each about 0.1 g, were dissolved in about 10 ml of benzyl alcohol while being heated for about 3 minutes, about 5 minutes, and about 7 minutes, respectively, so as to prepare three sample solutions. The sample solutions were subjected to neutralization titration with 0.1 N NaOH. The titer value at time 0 was extrapolated, and the amount of carboxylic acid terminal group (equivalent amount/$10^6$ g) was calculated from the extrapolated titer value at time 0.

(4) Hygroscopicity (M %): Calculated from the increase from the absolute dry weight (S0) of the final product to the weight) (S1) after leaving for about 48 hours under a standard environment temperature/humidity (20 C.×65% RH) as follows.

$$\text{Hygroscopicity (M \%)}=(\mathbf{S1}-\mathbf{S0})\times 100/\mathbf{S0}$$

(5) Ammonia deodorizing property: Ammonia water was dripped into a 3-liter plastic container so that the ammonia concentration therein was an about 100 ppm equivalent concentration. Then, about 3 g of a sample was placed in the container, and the container was sealed. After leaving the container standing for about 20 minutes, the ammonia concentration in the plastic container was measured using a gas detecting tube from Gas-Tech.

(6) SR soil resistance: A single drop of fuel oil B was dripped onto a sample surface. After about 30 minutes, the sample was washed once according to the process as described in JIS-L-0217-103, and dried. Then, the remaining soil level was determined to be one of Grade 1 (poor) to Grade 5 (excellent) using the gray scale for assessing staining as described in JIS-L-0805.

(7) Antistatic property: The frictionally-charged voltage under a 20° C.×40% RH environment was measured by the method as described in JIS-L-1094, 5.2.

(8) Amount of remaining phthalimide-type compound: About 5 g of a final product was placed in a packed tube, and heated at about 180° C. for about 15 minutes. The generated gas was extracted with chloroform, and the amount of the remaining phthalimide-type compound was measured by gas chromatography.

(9) Agglutination: the presence/absence of agglutination was determined by observing a reflection electron image with a scanning electron microscope (S-3500N, from Hitachi, Ltd.) at an acceleration voltage of about 15 kv, a degree of vacuum of about 1 Pa, and a magnification of about 1000.

Examples 1, 3, 4, and Comparative Examples 1, 2, 3

To each about 0.1 wt % of benzoyl peroxide as a hydrophobic radical initiator, various amounts of N-butyl phthalimide as shown in Table 1 below were added, and polyethylene glycol and an anion-type surfactant were further added thereto, thus obtaining aqueous emulsions. Further to the aqueous emulsions, each about 3 wt % of a mixed monomer comprising equal amounts of acrylic acid and methacrylic acid was added, and sodium carbonate was further added thereto, thus adjusting the respective pH values of the graft polymerization baths, as shown in Table 1. A polyethylene terephthalate filament textured yarn fabric (75 d/36 f) having a weight of about 1/15 of that of the obtained graft polymerization bath was immersed in the graft polymerization bath, and graft polymerization was allowed under a nitrogen gas atmosphere at about 100° C. for about 1 hour. Then, the obtained fabric was washed with boiling water for about 30 minutes, and dried with a dryer (at about 150° C. for about 5 minutes), thereby obtaining a final product.

Example 2

A final product was obtained in the same manner as that of Example 1 except that nylon 6 filament textured yarn fabric (75 d/36 f) was used as the hydrophobic textile product.

For each of the textile products obtained in the above-described examples and comparative examples, the agglutination of the byproduct polycarboxylic acid after graft polymerization, the graft rate (a rate of increase in weight with respect to the initial weight), the amount of the remaining N-alkylphthalimide, and the odor of the final product were determined. The ammonia deodorizing property was also measured. The results are shown in Table 1 below.

TABLE 1

| | Hydrophobic polymer product | Amount of N-butyl phthalimide added (wt %) | Amount of monomer added (wt %) | Amount of sodium carbonate added (g/L) | pH of graft both at room temperature | Agglutination after graft polymerization | Graft rate (%) | Amount of remaining N-butyl phthalimide (ppm) | Odor of final product | Ammonia deodorizing property (ppm) | Hygroscopicity (%) |
|---|---|---|---|---|---|---|---|---|---|---|---|
| Example 1 | Polyester | 0.5 | 3 | 0.5 | 3 | No | 17.5 | 1000 | No | 0 | 2.5 |
| Example 2 | Nylon | 1.0 | 3 | 0.5 | 3.1 | No | 12.4 | 460 | No | 0 | 6.1 |
| Example 3 | Polyester | 2.5 | 3 | 0.5 | 3 | No | 20.2 | 2400 | Some | 0 | 2.9 |
| Comparative example 1 | Polyester | 0.5 | 3 | 0 | 2.4 | Yes | 7.7 | 960 | No | 10 | 1.0 |
| Comparative example 2 | Polyester | 0.5 | 3 | 1.5 | 3.7 | Yes | 6.3 | 980 | No | 10 | 0.9 |
| Example 4 | Polyester | 0.5 | 12 | 1.5 | 2.6 | Slight | 54.5 | 965 | No | 0 | 4.8 |
| Comparative example 3 | Polyester | 0.0 | 3 | 0.5 | 2.9 | Slight | 0.5 | — | No | 90 | 0.4 |

According to these examples of the present invention, it is possible to obtain a hydrophobic textile product which is graft-polymerized at a high reaction rate and has substantially no agglutination of the byproduct polymer and a desirable uniformity. Moreover, a final product made from such a hydrophobic textile product has very little odor, and thus has good consumer acceptance. Furthermore, the product has a graft polymerization rate which is highly reproducible and the byproduct polymer can easily be removed therefrom, thus providing a significant industrial advantages as the product can be practically acceptable even when reducing the number of the extraction process steps.

Examples 5, 6 and Comparative Examples 4, 5

Emulsifier aqueous solutions were prepared from benzoyl peroxide (BPO), N-butyl phthalimide, polyethylene glycol and an anion-type surfactant. To each of the prepared solutions, a mixed monomer comprising equal amounts of acrylic acid and methacrylic acid was added, and sodium carbonate was further added thereto for adjusting the pH to about 3.0, thus obtaining graft polymerization baths. The amounts of N-butyl phthalimide and the monomer added with respect to each bath are shown in Table 2 below. BPO had a concentration of about 0.1 wt % in each polymerization bath. A polyethylene terephthalate filament textured yarn fabric (75 d/36 f) having a weight of about 1/15 of that of the obtained polymerization bath was immersed into the polymerization bath, and graft polymerization was allowed under a nitrogen gas atmosphere at about 100° C. for about 1 hour. Then, the obtained fabric samples were washed with hot water at about 80° C. for about 10 minutes, and processed at about 70° C. for about 10 minutes using industrial water (total hardness of about 38 ppm in sodium carbonate equivalent), and further using an aqueous solution containing sodium hydroxide and tetrasodium diethylenediaminetetraccetate (EDTA4Na) (Examples 5, 6, and Comparative Example 5), or an aqueous solution of sodium hydroxide without EDTANa (Comparative Example 4). Then, each sample was washed with hot water, and dried with a dryer (at about 140° C. for about 10 minutes), thereby obtaining a final product.

For each product of the textile products obtained in the above-described examples and comparative examples, the graft polymerization rate, the hygroscopicity, the amount of the remaining N-alkylphthalimide, and the odor of the final product were determined. The results are shown in Table 2 below.

TABLE 2

| | Amount of N-butyl phthalimide added (wt %) | Amount of monomer added (wt %) | Alkali process bath: Sodium hydroxide (g/L) | Alkali process bath: EDTA4No (g/L) | Graft rate (%) | Alkali metal salt conversion rate | Hygroscopicity (%): Initial | Hygroscopicity (%): After washing | Amount of remaining N-butyl phthalimide (ppm) | Odor of final product | Ammonia deodorizing property (ppm) |
|---|---|---|---|---|---|---|---|---|---|---|---|
| Example 5 | 0.5 | 3.0 | 1.0 | 0.2 | 17.5 | 100 | 10.3 | 8.2 | 1000 | No | 40 |
| Example 6 | 1.0 | 3.0 | 1.0 | 0.2 | 19.4 | 100 | 11.4 | 8.6 | 1240 | No | 35 |
| Comparative Ex. 4 | 0.5 | 3.0 | 1.0 | 0.0 | 17.3 | 13 | 2.4 | 2.0 | 1170 | No | 2 |
| Comparative Ex. 5 | 0.0 | 3.0 | 1.0 | 0.2 | 0.5 | 100 | 0.7 | 0.6 | 0 | No | 90 |

According to these examples of the present invention, it is possible to obtain a hygroscopic textile product with a desirable washing resistance. The product containing such a textile has a very good consumer acceptance as it has very little odor, a desirable washing resistance including hygroscopicity, as well as an ammonia deodorizing property which is not substantially changed after washing.

Examples 7–11, and Comparative Example 6

Aqueous emulsions were prepared from benzoyl peroxide, N-butyl phthalimide, polyethylene glycol and an anion-type surfactant. To each of the prepared emulsions, a mixed monomer comprising equal amounts of acrylic acid and methacrylic acid was added, and sodium carbonate was further added thereto for adjusting the pH to about 3.3, thus obtaining graft polymerization baths. The concentrations of N-butyl phthalimide and the monomer in each graft polymerization bath are shown in Table 3 below. About 0.1 wt % of benzoyl peroxide was used in each graft polymerization bath. A polyethylene terephthalate filament textured yarn fabric (75 d/36 f) having a weight of about 1/15 of that of the obtained polymerization bath was immersed into the polymerization bath, and graft polymerization was allowed under a nitrogen gas atmosphere at about 100° C. for about 1 hour. Then, the obtained fabric samples were washed with hot water at about 80° C. for about 10 minutes. The samples were processed at about 70° C. for about 10 minutes using an aqueous solution containing about 3 g/L of sodium-carbonate and about 0.5 g/L of tetrasodium diethylenediaminetetraacetate. This process was repeated for a number of time until the solution had a predetermined pH. Then, each sample was washed with hot water, and dried with a dryer (at about 140° C. for about 10 minutes), thereby obtaining a final product.

Example 8

A final product was obtained in the same manner as that of Example 7 except that a polyethylene terephthalate cotton (6 d-64 mm) having a weight of about 1/10 of that of the polymerization bath was used instead of the polyethylene terephthalate filament textured yarn fabric.

For each of the textile products obtained in the above-described examples and comparative examples, the graft polymerization rate, the hygroscopicity, the ammonia deodorizing property, the amount of the remaining N-alkylphthalimide, and the odor of the final product were determined. The results are shown in Table 3 below.

TABLE 3

| | Amount of N-butyl phthalimide added (wt %) | Amount of monomer added (wt %) | Alkali process | | Graft rate (%) | Alkali metal salt conversion rate | Hygroscopicity (%) | | Ammonia deodorizing property (ppm) | | Amount of remaining N-butyl phthalimide (ppm) | Odor of final product |
|---|---|---|---|---|---|---|---|---|---|---|---|---|
| | | | Number of processes | Bath pH | | | Initial | After washing | Initial | After washing | | |
| Example 7 | 0.5 | 4.0 | 2 | 8.8 | 20.2 | 80 | 10.3 | 8.2 | 2 ppm | 2 ppm | 970 | No |
| Example 8 | 0.5 | 3.0 | 3 | 9.1 | 18.8 | 90 | 10.4 | 8.5 | 8 ppm | 7 ppm | 850 | No |
| Example 9 | 0.5 | 4.0 | 1 | 7.2 | 20.2 | 40 | 6.1 | 4.9 | 0 ppm | 0 ppm | 1050 | No |
| Example 10 | 0.5 | 4.0 | 4 | 10.6 | 20.2 | 100 | 14.5 | 11.0 | 30 ppm | 35 ppm | 740 | No |
| Example 11 | 0.5 | 2.0 | 1 | 8.0 | 9.5 | 90 | 5.3 | 4.0 | 10 ppm | 10 ppm | 1040 | No |
| Comparative Ex. 6 | 0.0 | 4.0 | 2 | 8.1 | 0.5 | 100 | 0.7 | 0.6 | 80 ppm | 90 ppm | — | No |

According to these examples of the present invention, it is possible to obtain a textile product having a desirable washing resistance including hygroscopicity, and ammonia deodorizing property, which is suitable in various applications such as clothing, bedding, household commodities, and interior goods. A product including such a textile product has very little odor, and the desirable properties can be retained after washing.

Examples 12–15

A polyethylene terephthalate filament false-twisted yarn (150 d/48 f) was softly wound at a winding density of about 0.3 g/cc using a general-purpose cheese winder, and then scoured by an ordinary method with an overmayer type dying machine. A mixed monomer comprising equal amounts of acrylic acid and methacrylic acid was added to an aqueous emulsion containing about 0.1 wt % of benzoyl peroxide and N-butyl phthalimide/ethylene glycol at a weight ratio of about 8/2, thus obtaining a graft polymerization bath. The pH of the graft polymerization bath was adjusted to about 3.3 with sodium carbonate. The graft polymerization bath was adjusted at about 50° C. so that the weight ratio of sample:bath (=bath ratio) is about 1:15. The bath was heated while setting the stream direction to the In→Out direction, and graft polymerization was allowed under a nitrogen gas atmosphere at about 100° C. for about 1 hour. The graft polymerization process liquid was discharged at a high temperature, and each sample was washed with hot water at about 80° C. for about 10 minutes. Each sample was subjected to an alkali metal salt conversion process at about 70° C. for about 10 minutes using an alkaline aqueous solution containing about 3 g/L of sodium carbonate and about 0.5 g/L of tetrasodium diethylenediaminetetraacetate. This process was repeated for a number of times until the solution had a predetermined pH. Then, each sample was washed with hot water, dewatered by an ordinary method, and dried under a reduced pressure at about 100° C. After the obtained polyester filament false-twisted yarn was corn-rewound, a circular knitting fabric having a nominal density of about 200 g/m$^2$ was made. The fabric was scoured and dried in an ordinary manner, and subjected to a dry heat process at about 160° C. for about 10 minutes, thus obtaining a final product.

For each of the textured circular knitting fabrics obtained in the above-described examples, the graft polymerization rate, the alkali metal salt conversion rate, the hygroscopicity, the ammonia deodorizing property, the SR soil resistance, the antistatic property, the amount of the remaining N-alkylphthalimide, and the odor of the final product were determined. The results are shown in Table 4 below.

TABLE 4

| | Example 12 | Example 13 | Example 14 | Example 15 |
|---|---|---|---|---|
| Amount of N-butyl phthalimide added (wt %) | 0.5 | 0.5 | 0.5 | 0.5 |
| Amount of hydrophilic monomer added (wt %) | 4.0 | 4.0 | 4.0 | 4.0 |
| Number of alkali processes | 2 | 3 | 0 | 4 |
| Process bath pH | 8.9 | 9.2 | 5.6 | 10.9 |

TABLE 4-continued

| | | Example 12 | Example 13 | Example 14 | Example 15 |
|---|---|---|---|---|---|
| Graft rate (%) | | 20.5 | 19.8 | 20.1 | 20.2 |
| Alkali metal salt conversion rate (%) | | 80 | 90 | 0 | 100 |
| Hygro-scopicity (%) | Initial | 10.3 | 10.5 | 2.9 | 14.6 |
| | After washing | 8.6 | 8.9 | 3 | 10.5 |
| Ammonia deodorizing property (ppm) | Initial | 3 | 9 | 0 | 33 |
| | After washing | 3 | 8 | 0 | 36 |
| SR soil resistance (Grade) | Initial | 3 | 3 | 1~2 | 3~4 |
| | After washing | 3 | 3 | 1 | 3 |
| Antistatic property frictionally-charged voltage (V) | Initial | 800 | 750 | 1100 | 700 |
| | After washing | 800 | 800 | 1050 | 750 |
| Amount of remaining N-butyl phthalimide (ppm) | | 450 | 460 | 490 | 370 |
| Odor of final product | | No | No | No | No |

According to these examples of the present invention, it is possible to obtain a polyester-based textile product in a safe and efficient manner through graft polymerization of an ethylenically unsaturated organic acid, which has a desirable washing resistance, hygroscopicity, ammonia deodorizing property, SR soil resistance, and antistatic property, and which can be used in various functional material applications where improved comfort/convenience is desired, such as clothing, bedding, interior goods, vehicle interior goods, household commodities, or industrial materials. The product has very little odor, and the desirable properties can be retained after washing.

Examples 16, 17

A polyester stable fiber (Toyobo Co., Ltd.: ESUP R) about 6 Denier, having a fiber length of about 64 mm, and three-dimensional crimping with a hollow cross section was subjected to a graft polymerization process at about 10° C. for about 40 minutes using a overmayer type dying machine and an aqueous solution having a monomer concentration of about 5% at a bath ratio of about 1:15.

The monomer used in the process contained acrylic acid and methacrylic acid at a ratio of about 1:1. Benzoyl peroxide was used as a polymerization initiator, N-butyl phthalimide as a carrier, and soda ash as a pH adjuster.

After the graft polymerization, an alkali process was performed at about 70° C. for about 20 minutes using soda ash and sodium tripolyphosphate so that the pH of the waste liquid was about 7.

The graft polymerization rate at this point was about 35%, and the moisture content in a normal state was about 12%. The product had an alkali metal salt conversion rate of about 60% and a desirable deodorizing property with an ammonia deodorizing property of about 0 ppm.

The properties of the unprocessed polyester staple fiber and the graft-polymerized highly hygroscopic polyester staple fiber are shown in Table 5 below.

Then, oil agents having respective compositions as shown in Table 6 were added to the highly hygroscopic polyester staple fiber. The staple fiber-metal static friction coefficient, the carding machine passing amount, and the carding machine passing time in seconds were measured as follows. The results are also shown in Table 6 below.

(A) Measurement of staple fiber-metal static friction coefficient

According to the friction coefficient measurement as described above in JIS-L-1015-1992, 7.13, but instead of using a cylindrical sliver, directly winding the measured sample around a cylinder.

The cylinder used was obtained by hard chrome plating on a stainless steel such that the maximum height ($R_{max}$) as measured by SURFTEST SV402 available from Mitsutoyo was about 7.0 $\mu$m, and the center line average roughness (Ra) was about 1.0 $\mu$m.

(B) Carding macing passing amount and carding machine passing time

About 20 g of cotton was disentangled by hand, and fibrillated by a miniature carding machine. The carding machine passing time was measured as a period of time from the time at which the sample was placed into the carding machine to the time at which the cotton was completely discharged from the doffer roll, and the carding machine passing amount was measured as the total amount of cotton discharged. The carding machine passing amount is an indication of the amount of cotton fallen in the carding machine, and the carding machine passing time indicates the fibrillability of the cotton sample which is a measure of productivity. A larger carding machine passing amount and a shorter carding machine passing time indicate better productivity with a carding machine (the card machine passing property).

TABLE 5

| | Unprocessed polyester fiber | Highly hygroscopic polyester fiber |
|---|---|---|
| Denier (d) | 7.0 | 9.4 |
| Strength (g/d) | 3.5 | 1.8 |
| Elongation (%) | 45 | 33 |
| Number of crimps (crimps/25 mm) | 12 | 12 |
| Crimp rate (%) | 28 | 27 |
| Fiber length (mm) | 64 | 64 |

TABLE 6

| | Example 16 | Example 17 | Example 18 |
|---|---|---|---|
| Oil agent composition (see Notes below) | A | B | C |
| Oil agent attachment rate (%) | 0.15 | 0.20 | 0.15 |
| Staple fiber-metal static friction coefficient | 0.16 | 0.13 | 0.21 |
| Carding machine passing amount (g) | 17.5 | 18.0 | 15.5 |
| Carding machine passing time (sec) | 31.0 | 25.2 | 38.5 |

(Notes)

A: About 70 parts of PO/EO polyester, about 20 parts of POE alkylether, and about 10 parts of alkylamide ammonium type cation compound and other components B: About 75 parts of amino denatured silicon, about 5 parts of diaminodimethoxysilane, and about 20 parts of an emulsifier, antistatic agent and other components C: About 90 parts of stearyl phosphate K salt, about 10 parts of POE alkylether and other components It can be seen from the above results that a polyester staple fiber whose staple fiber-metal static friction coefficient is reduced has a desirable productivity with a carding machine (the card machine passing property).

The staple fiber according to these examples has a high hygroscopicity which has not been available in the past, and has a desirable productivity with a carding machine, i.e., a desirable card machine passing property. Thus, the staple fiber is useful in various applications such as nonwoven fabric, wadding for bedding, and spinning.

Examples 19, 20

Aqueous emulsions were prepared from about 0.1 wt % of benzoyl peroxide, N-butyl phthalimide, sodium carbonate, polyethylene glycol and an anion-type surfactant. To each of the prepared emulsions, a mixed monomer comprising equal amounts of acrylic acid and methacrylic acid was added, thus containing graft polymerization baths. A polyethylene terephthalate cotton (6 d-64 mm) having a weight of about 1/15 of that of the obtained bath was immersed into the polymerization bath, and graft polymerization was allowed under a nitrogen gas atmosphere at about 100° C. for about 1 hour. Then, the obtained fabric samples were washed with hot water at about 80° C. for about 10 minutes. The samples were processed at about 70° C. for about 10 minutes using an aqueous solution containing about 3 g/L of sodium carbonate and about 0.5 g/L of tetrasodium diethylenediaminetetraacetae. This process was repeated for a number of times until the solution had a predetermined pH. Then, each sample was washed with hot water, and dried with a dryer (at about 140° C. for about 10 minutes), thereby obtaining a final product.

For each of the products obtained in the above-described examples, the modified cross-section coefficient, the graft polymerization rate, the alkali metal salt conversion rate, the hygroscopicity, the ammonia deodorizing property, the amount of the remaining N-alkylphthalimide and the odor of the final product were determined. The results are shown in Table 7 below. The alkali metal salt conversion rate was about 80% in Example 19 and about 90% in Example 20.

which has a desirable washing resistance, a light weight, low bulk density, a high hygroscopicity, an ammonia deodorizing property, and which is suitable in various applications such as clothing, bedding, household commodities, and interior goods. The textile product or a product including the textile product has very little odor, and the desirable properties can be retained after washing.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A hydrophobic textile product which is obtained through graft polymerization of an ethylenically unsaturated organic acid, the textile product characterized by: a graft polymerization rate of about 8 wt % or more; substantially no agglutination of a byproduct polymer from the graft polymerization process; a hygroscopicity of about 2.5 wt % or more under a 20° C.×65% RH environment; and an ammonia deodorizing property.

2. A textile product according to claim 1, wherein the hydrophobic textile product is a polyester-based textile product.

3. A textile product according to claim 1, wherein about 40% or more of acidic groups introduced by the graft polymerization process is converted to an alkali metal salt.

4. A textile product according to claim 3, wherein about 40 to about 95% of the acidic group is converted to an alkali metal salt.

5. A textile product according to claim 1, wherein the hygroscopicity is about 5 wt % or more.

6. A textile product according to claim 1, wherein the graft polymerization rate is about 10 to about 40 wt %.

7. A textile product according to claim 2, wherein the textile product is a staple fiber, and a staple fiber-metal static friction coefficient thereof is about 0.17 or less.

8. A textile product according to claim 2, wherein the textile product has a hygroscopicity of about 4 wt % or more

TABLE 7

| | Amount of N-butyl phthalimide | Amount of monomer | | Modified cross-section | Alkali process | | Graft | Hygro-scopicity (%) | | Ammonia deodorizing property (ppm) | | Amount of remaining N-butyl | Odor of |
|---|---|---|---|---|---|---|---|---|---|---|---|---|---|
| | added (wt %) | added (wt %) | Cross section | coefficient R | Number of processes | Bath pH | rate (%) | Initial | After washing | Initial | After washing | phthalimide (ppm) | final product |
| Example 19 | 0.5 | 4 | Hollow | 6.2 | 2 | 8.6 | 22.1 | 10.4 | 8.4 | 5 ppm | 5 ppm | 890 | No |
| Example 20 | 0.5 | 3 | Triangular hollow | 7.3 | 3 | 9.2 | 23.2 | 11.3 | 9.1 | 10 ppm | 10 ppm | 850 | No |

The modified cross-section coefficient was obtained as follows.

Modified cross-section coefficient: (R): A cross section of a fiber was imaged by a commercially-available optical microscope, and the sum of the lengths of inner and outer peripheries of the fiber cross section and the cross-sectional area of the fiber were calculated using an image processing software. Then, the coefficient (R) was calculated according to the following expression.

Modified cross-section coefficient (R)=Sum of lengths of inner and outer peripheries of the fiber cross section/(cross-sectional area of the fiber)$^{1/2}$ According to these examples of the present invention, it is possible to obtain a polyester textile product through graft polymerization of an ethylenically unsaturated organic acid, under a 20° C.×65% RH environment after 10 iterations of a washing test as described in JIS-L-0217-103.

9. A textile product according to claim 2, wherein the textile product has an SR soil resistance and an antistatic property.

10. A textile products according to claim 2, wherein the polyester-based textile product is a polyethylene terephthalate textile product.

11. A textile product according to claim 2, wherein the polyester-base textile product has a hollow cross section.

12. A textile product according to claim 2, obtained by a method comprising the steps of:

heating a polyester-based textile product in an aqueous emulsion containing a hydrophobic radical initiator, a phthalimide-type compound an dan ethylenically unsaturated organic acid, so as to allow graft polymerization, and processing the graft-polymerized polyester-based textile product with an aqueous solution containing a basic alkali metal compound and a sequestering agent.

13. A method for producing a textile product according to claim 1, the method comprising the step of:

heating a hydrophobic textile product in an aqueous emulsion containing a hydrophobic radical initiator, a phthalimide-type compound and an ethylenically unsaturated organic acid, so as to allow graft polymerization, wherein the aqueous emulsion is adjusted by a basic alkali metal compound so that the pH thereof is about 2.5 to about 3.5 room temperature.

14. A method according to claim 13, further comprising the step of adding an aqueous solution containing a basic alkali metal compound so as to adjust the pH to be about 8 or more and less than about 11.

15. A method according to claim 13, further comprising the step of adding an aqueous solution containing a basic alkali metal compound so as to adjust the pH to be about 8 or more and less than 10.

16. A method according to claim 13, wherein the aqueous emulsion further contains a sequestering agent.

17. A method according to claim 13, wherein an amount of the phthalimide-type compound remaining in the obtained textile product is about 2000 ppm or less.

18. A method according to claim 13, further comprising the step of performing a process using an aqueous solution containing a basic alkali metal compound so as to convert about 40 to about 95% of acidic groups introduced by the graft polymerization process to an alkali metal salt.

19. A method according to claim 13, wherein the ethylenically unsaturated organic acid comprises acrylic acid and/or methacrylic acid.

* * * * *